United States Patent [19]

Ikeda

[11] Patent Number: 4,618,859

[45] Date of Patent: Oct. 21, 1986

[54] GRAPHIC DISPLAY UNIT

[75] Inventor: Yoshiaki Ikeda, Hachioji, Japan

[73] Assignee: Fanuc Ltd., Tokyo, Japan

[21] Appl. No.: 584,360

[22] Filed: Feb. 28, 1984

[30] Foreign Application Priority Data

Mar. 2, 1983 [JP] Japan ..... 58-32940

[51] Int. Cl.[4] ..... G09G 1/06

[52] U.S. Cl. ..... 340/724; 340/747

[58] Field of Search ..... 340/709, 723, 724, 726, 340/733, 736, 747

[56] References Cited

U.S. PATENT DOCUMENTS 4,070,662 1/1978 Narveson ..... 340/726

4,320,395 3/1982 Meissen et al. ..... 340/726

4,412,294 10/1983 Watts et al. ..... 340/726

*Primary Examiner*—Gerald L. Brigance

*Assistant Examiner*—Vincent P. Kovalick

*Attorney, Agent, or Firm*—Armstrong, Nikaido, Marmelstein & Kubovcik

[57] ABSTRACT

A graphic display unit having a shifting circuit for shifting a picture image to a designated position on or off a display panel, the shifting circuit including a signal delaying circuit for delaying a divided clock signal obtained by dividing a main clock signal and for delaying a display timing signal in accordance with the designated amount of shift of the picture image, whereby, in response to the delayed divided clock signal and the delayed display timing signal, the data of the picture image is read from a graphic random access memory.

3 Claims, 13 Drawing Figures

GRAPHIC DISPLAY UNIT

BACKGROUND OF THE INVENTION (1) Field of the Invention

The present invention relates to a graphic display unit which can shift a displayed picture to any desired position by hardware.

(2) Description of the Prior Art

Generally, a graphic display unit comprises a graphic random access memory (RAM) for storing data of a plurality of picture images and a display unit such as a cathode-ray tube (CRT) for displaying, on a display panel, a picture by superimposing the plurality of picture images. In such a graphic display unit, it is often necessary to shift one or more picture images on the display panel to any desired position.

Conventionally, to shift a picture image on the display panel, read addresses of the graphic RAM are changed, by software, by the necessary amount of shift so as to rewrite the picture on the display panel. Due to the use of software, however, there is a problem in that it takes a considerably long time of, for example, several seconds to change the read addresses and to rewrite the picture on the display panel.

SUMMARY OF THE INVENTION

Accordingly, an object of the present invention is to increase the speed for shifting a picture on a display panel of a graphic display unit by means of hardware.

Another object of the present invention is to provide an improved graphic display unit which can read data from a graphic RAM and display it with an appropriate timing in accordance with the required amount of shift by means of hardware.

To attain the above objects, there is provided, according to the present invention, a graphic display unit comprising a graphic RAM for storing data of at least one picture image, a clock signal generating means for generating a main clock signal and a divided clock signal obtained by dividing the main clock signal, a control means for generating a display timing signal synchronous with the divided clock signal, and a display panel for displaying the data stored in the graphic RAM while said display timing signal is on.

The graphic display unit further comprises a shifting means for shifting the picture image to a designated position on or off the display panel.

The shifting means comprises a signal delaying means for delaying the divided clock signal and the display timing signal in accordance with the designated amount of shift of the picture image, whereby, in response to the delayed divided clock signal and the delayed display timing signal, the data of the picture image is read from the graphic RAM.

BRIEF DESCRIPTION OF THE DRAWINGS

The above objects and features, as well as other features and advantages of the present invention, will be more apparent from the following description of the preferred embodiment with reference to the accompanying drawings, wherein.

DESCRIPTION OF THE PREFERRED EMBODIMENT

An embodiment of the present invention is described below with reference to the drawings.

Figure 1:
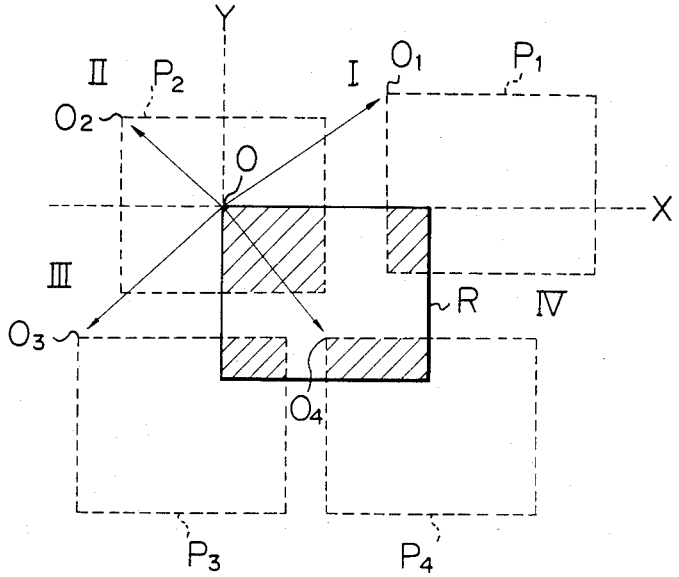
FIG. 1 is a diagram showing shifts of a picture image, realized in accordance with the present invention.

FIG. 1 is a diagram showing shifts of a picture image, realized in accordance with the present invention. In the figure, R represents a display panel of a CRT display unit. The upper left corner of the display panel R is assumed to be an origin O. The data of a picture image is assumed to be previously stored in a graphic RAM. When the amount of shift of the picture image is zero, all of the data of the picture image is displayed on the display panel R so that the origin of the picture image coincides with the origin O of the display panel R. By means of the present invention as described later in detail, the origin of the picture image can be shifted to any desired position on or off of the display panel R. In FIG. 1, four picture images $P_1$ through $P_4$ having origins $O_1$ through $O_4$, respectively, and which are shifted with respect to the display panel R are illustrated. Consider a rectangular coordinate system having an X axis and a Y axis crossing each other at the origin O of the display panel R. Assume also that the upper side of the display panel R is part of the X axis and that the left side of the display panel R is part of the Y axis. Then the origins $O_1$ through $O_4$ of the shifted picture images $P_1$ through $P_4$ are present on the first quadrant I, on the second quadrant II, on the third quadrant III, and on the fourth quadrant IV, respectively. The maximum amount of shift of the origin of each shifted picture image, for displaying at least a part of the shifted picture image on the display panel R, is four times the number of dots on the display panel R. On each shifted picture image, the overlapped portion between the shifted picture image and the display panel R, illustrated by the slanted lines, is a portion displayed on the display panel R.

In the following description, only a means for shifting the origin of the picture image to the first quadrant I or to the fourth quadrant IV is described because if such a means is realized a means for shifting the origin of the picture image to the second quadrant II or to the third quadrant III can easily be realized by adding simple hardware.

Figure 2:
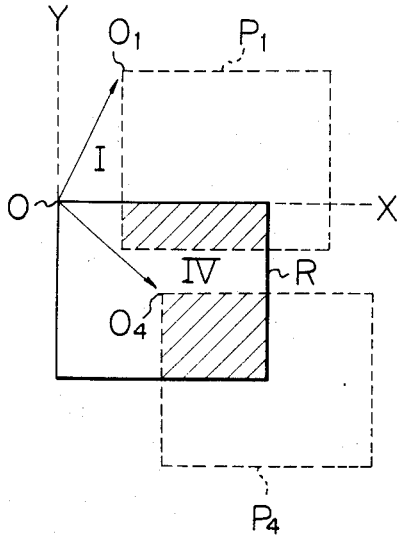
FIG. 2 is a diagram showing the origin of the picture image being shifted to the first quadrant or the fourth quadrant.

FIG. 2 is a diagram showing the origin of the picture image being shifted to the first quadrant I or to the fourth quadrant IV.

Figure 3:
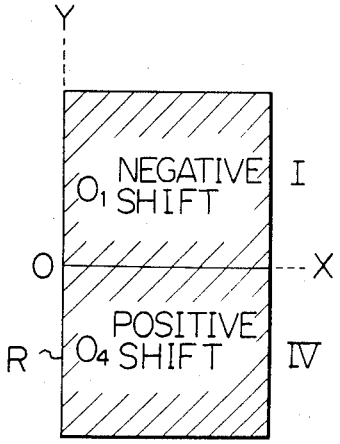
FIG. 3 is a diagram showing the extent to which the origin of the picture image can be shifted in the case of FIG. 2.

FIG. 3 is a diagram showing the extent to which the origin of the picture image can be shifted in the case of FIG. 2. As will be apparent from FIG. 3, in order to display at least a part of the picture image on the display panel R, the origin $O_1$, which is shifted within the first quadrant I, should be in a region adjacent to the region of the display panel R and should be in a region having the same shape as the region of the display panel R. The region in which the origin $O_1$ can shift is referred to as a negative shift region. Similarly, the origin $O_4$, which is shifted within the fourth quadrant IV, should be in the region of the display panel R. The region in which the origin $O_4$ can shift is referred to as a positive shift region.

Figure 4A:
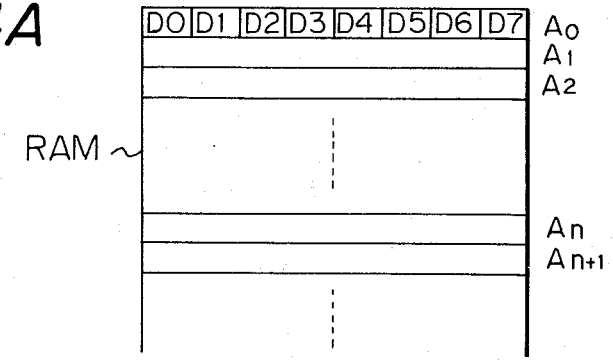
FIGS. 4A through 4D are diagrams showing a corresponding relationship between the contents of a graphic RAM and data on a display panel.

FIGS. 4A through 4D are diagrams showing a corresponding relationship between the contents of a graphic RAM and data on the display panel R, according to the present invention. FIG. 4A is a diagram showing the contents of the graphic RAM. In FIG. 4A, each of the reference symbols $A_0, A_1, A_2, \ldots, A_n, A_{n+1}, \ldots$ represents an address for one byte of data. Each byte consists of 8 bits of data $D_0, D_1, \ldots$, and $D_7$. Each data bit $D_0, D_1, \ldots$, and $D_7$ is displayed on the display panel R as one dot.

Figure 4B:
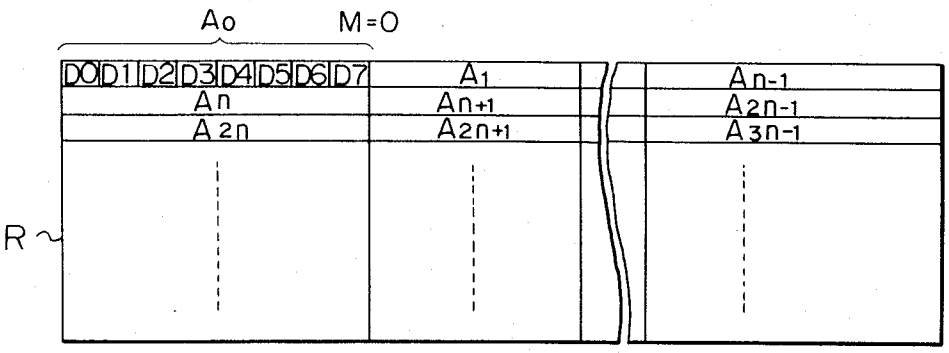

FIG. 4B is a diagram schematically showing, when the amount of shift M is zero, data corresponding to the dots displayed on the display panel R. In FIG. 4B, in the first row extending in a horizontal direction on the display panel R, n bytes of data from the addresses $A_0$ through $A_{n-1}$ are displayed, where n is a positive integer for displaying one row; in the second row, n bytes of data from the addresses $A_n$ through $A_{2n-1}$ are displayed; in the third row, n bytes of data from the addresses $A_{2n}$ through $A_{3n-1}$ are displayed and so forth.

Figure 4C:
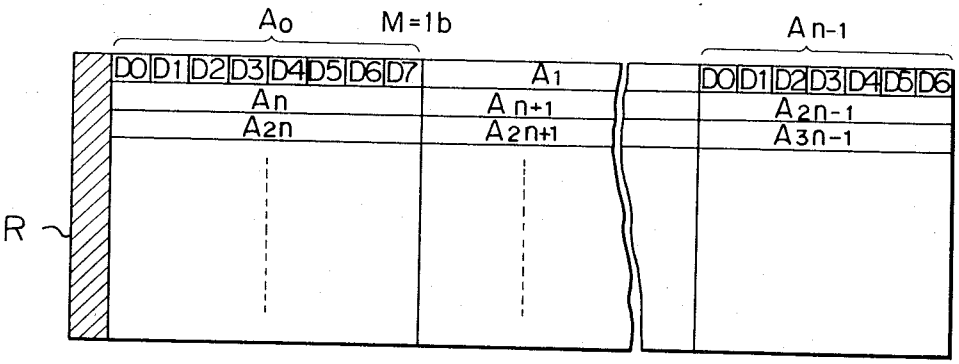

FIG. 4C is a diagram schematically showing, when the amount of shift M of the origin $O_1$ or $O_4$ is one bit, data corresponding to the dots displayed on the display panel R. In FIG. 4C, the bit on the extreme left in each row is not displayed due to the shift, as is illustrated by the slanted lines on the display panel R. Therefore, when compared with the picture displayed in the case of FIG. 4B, the picture displayed in the case of FIG. 4C is shifted by one bit to the right. As a result, the data bit $D_7$ on the extreme right in each row, i.e., the data $D_7$ from the addresses $A_{n-1}, A_{2n-1}, A_{3n-1}, \ldots$, is forced off the display panel R and therefore is not displayed.

Figure 4D:
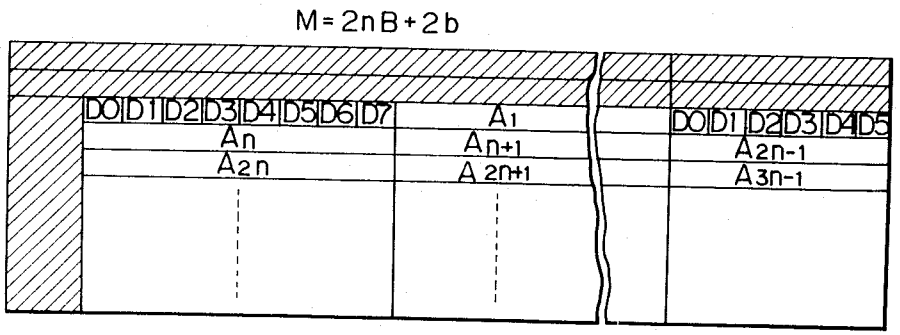

FIG. 4D is a diagram schematically showing, when the amount of shift M of the origin $O_4$ is equal to 2n bytes plus 2 bits, i.e., $(2n \times 8+2)$ bits, data corresponding to dots displayed on the display panel R. In FIG. 4D, a picture, which is shifted by 2n bytes for the first and the second rows and then is shifted by 2 bits to the left for each row, is displayed. In this case, a portion corresponding to the above-mentioned shift of 2n bytes plus 2 bits for each row is not displayed. Also, the 2 data bits $D_6$ and $D_7$ on the extreme right in each row, i.e., the data bits $D_6$ and $D_7$ from the addresses $A_{n-1}, A_{2n-1}, A_{3n-1}, \ldots$, is forced off the display panel R and therefore is not displayed. Further, the last two rows are also forced off from the display panel R so that they are not displayed.

Generally, the amount of shift can be expressed as $m \times n$ bytes plus x bits, where m and x are zero or a positive or a negative integer and x bits are smaller than n bytes.

In the case of FIG. 4B, $m=0$ and $x=0$. In the case of FIG. 4C, $m=0$ and $x=1$. In the case of FIG. 4D, $m=2$ and $x=2$.

Figure 5:
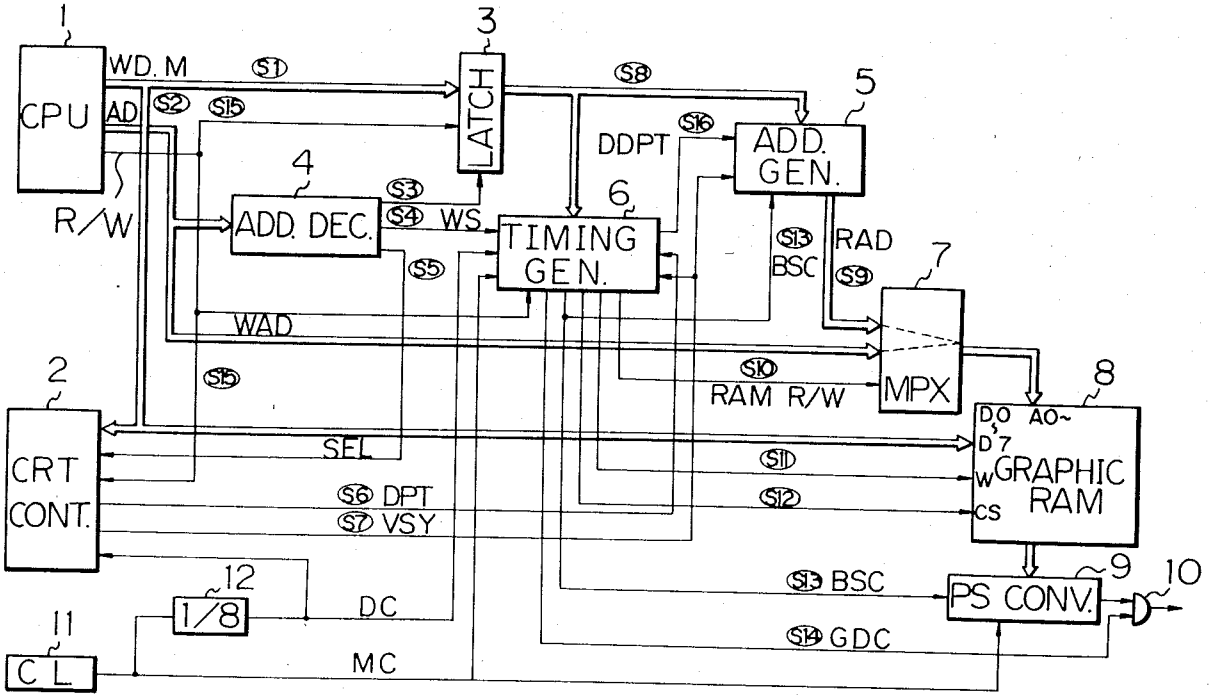
FIG. 5 is a block circuit diagram showing a graphic display unit according to an embodiment of the present invention.

FIG. 5 is a block circuit diagram showing a graphic display unit according to an embodiment of the present invention. In FIG. 5, reference numeral 1 represents a central processing unit (CPU); 2 represents a general CRT controller on the market for generating display timing signals, a vertical synchronizing signal, a horizontal synchronizing signal, and so forth; 3 represents a storage unit for latching data of the amount of shift transferred from the CPU 1; 4 represents an address decoder for decoding address signals transferred from the CPU 1; 5 represents an address generator for scanning a graphic RAM; 6 represents a timing signal generating circuit; 7 represents a multiplexer for switching between writing and reading; 8 represents the graphic RAM; 9 represents a parallel-serial converter; 10 represents an AND gate for controlling graphic dots; 11 represents a main clock signal generating circuit; and 12 represents a $\frac{1}{8}$ frequency divider.

The functions of the above-mentioned constituent elements in the circuit of FIG. 5 are generally described below.

The CPU 1, as is well known, controls the whole system by sending, on a CPU data bus S1, write data WD or data of the amount of shift M, by sending, on a CPU address bus S2, a write address signal WAD for designating either the storage unit 3 for latching data of the amount of shift, the graphic RAM 8, or the CRT controller 2, and by sending, on a read/write (R/W) control line S15, a read or a write (R/W) control signal.

The CRT controller 2 receives the write data WD from the CPU 1 through the CPU data bus S1, the R/W control signal from the CPU 1 through the R/W control line S15 and a CRT controller selecting signal (SEL) from the address decoder 4 through a selecting line S5. Based on this received data or signals, the CRT controller 2 provides, on a display timing signal line S6, a display timing signal DPT see FIG. 6(*d*) and FIG. 7(*a*)) which has n bytes of an ON signal during a horizontal display period for each row and an OFF signal during a horizontal blanking period for each row. The ON signal and the OFF signal are alternately repeated.

Figure 6:
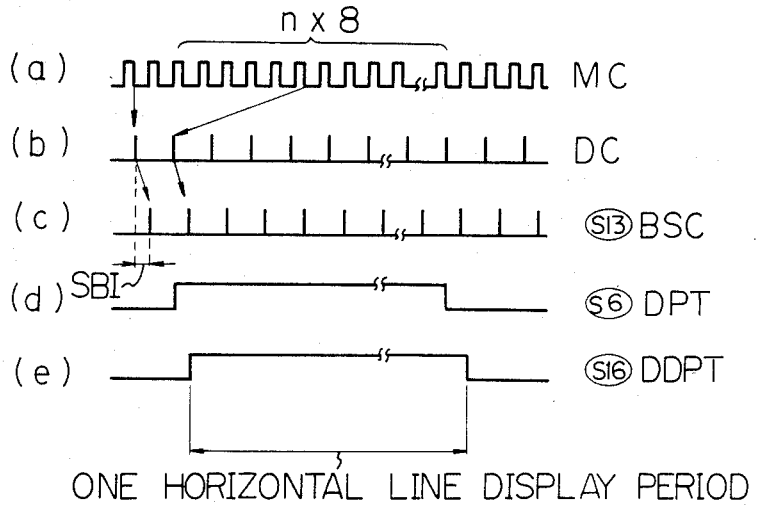
FIGS. 6 through 8 are signal waveform diagrams for explaining the function of a timing signal generating circuit.

The main clock signal generating circuit 11 generates a main clock signal MC (see FIG. 6(*a*)), in which each pulse corresponds to one bit.

The $\frac{1}{8}$ frequency divider 12 divides the main clock signal into a $\frac{1}{8}$ divided clock signal DC, in which each pulse corresponds to one byte.

The ON signal in the display timing signal DPT is synchronous with the $\frac{1}{8}$ divided clock signal.

The CRT controller 2 also provides, on a vertical synchronizing signal line S7, a vertical synchronizing signal VSY (see FIG. 8(b)) after one picture is displayed. Of course, a horizontal synchronizing signal is also provided by the CRT controller 2, but, for the sake of simplicity, it is not illustrated in the figure.

The storage unit 3 for latching the data of the amount of shift latches, in response to the write control signal W on line S15, the data of the amount of shift M transferred from the CPU 1 through the data bus S1. When the origin of the picture image is shifted to any one of the four quadrants I through IV, as is illustrated in FIG. 1, the memory capacity of the storage unit 3 is at least four times as much as the number of the displayed dots. When the origin of the picture image is shifted to either of the two quadrants I and IV, as is illustrated in FIG. 2, the memory capacity of the storage unit 3 is at least two times as much as the number of displayed dots.

The address decoder 4 decodes the address signal AD transferred from the CPU 1 through the CPU address bus S2 so as to select one of the output signal lines S3, S4, and S5. When the output signal line S3 is selected, a read/write operation of the data of the amount of shift M is carried out from or into the storage unit 3. When the output signal line S4 is selected, a write operation of graphic data is carried out into the graphic RAM 8. When the output signal line S5 is selected, a display operation on the display panel R is carried out.

The address generator 5 for scanning the graphic RAM 8 comprises an n-bit up counter for generating an address signal for reading each byte of data from the graphic RAM 8. The n-bit up counter of the address generator 5 counts each byte of the data of the amount of shift M stored in the storage unit 3 and provides, on a signal line S9, an address signal for reading each byte of data.

The timing signal generating circuit 6 controls the display timing based on the significant lower bits of the data of the amount of shift. The function of the timing signal generating circuit 6 will be described in more detail with reference to FIGS. 6, 7, and 8. In FIG. 6, waveforms (*a*), (*b*), and (*d*), respectively, represent a main clock signal MC from the main clock signal generating circuit, a $\frac{1}{8}$ divided clock signal DC from the $\frac{1}{8}$ frequency divider 12, and a display timing signal DPT from the CRT controller. These signals are supplied to the timing signal generating circuit 6. The timing signal generating circuit 6 also receives significant lower bits SBI (0 through 7 bits) smaller than one byte of the data of the amount of shift M stored in the storage unit 3 so as to delay the above-mentioned $\frac{1}{8}$ divided clock signal DC and the display timing signal DPT by the amount of the significant lower bits SBI, resulting in the generation of a bit-shift control signal BSC (FIG. 6(*c*)) and a delayed-display timing signal DDPT (FIG. 6(*e*)) on signal lines S13 and S16, respectively.

Figure 7:
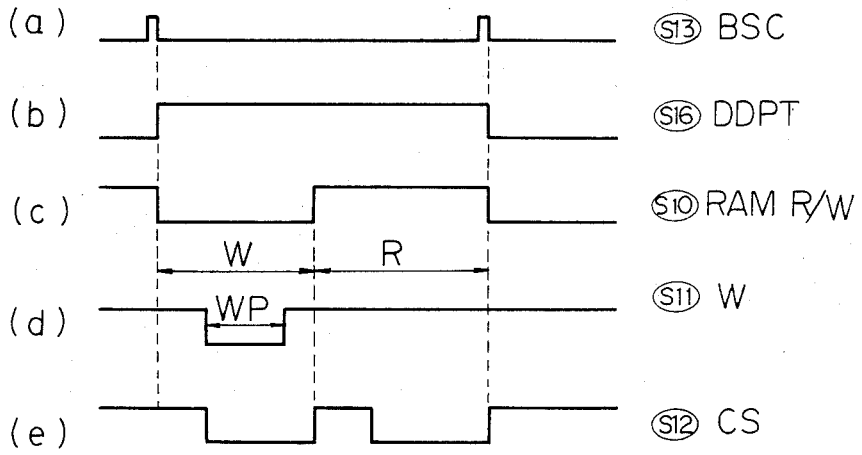

The timing signal generating circuit 6 further outputs a RAM R/W control signal on a signal line S10 for controlling switching between the read operation and the write operation in the graphic RAM 8. Since, as was mentioned before, the display timing is shifted in accordance with the significant lower bits SBI of the amount of shift, it is necessary to shift the writing operation from the CPU 1 to the graphic RAM 8. To this end, as is illustrated in FIG. 7, the RAM R/W control signal on the signal line S10 is rendered to be a low level "L" during the first half of the ON period of the delayed display timing signal DDPT and is rendered to be a high level "H" during the last half of the ON period of the delayed display timing signal DDPT. When the RAM R/W control signal on the signal line S10 is at the "L" level, the multiplexer 7 selects the write address signal WAD transferred from the CPU 1 through the address bus S2. When the RAM R/W control signal is at the "H" level, the multiplexer 7 selects the read address signal transferred from the address generator 5 through the signal line S9.

The timing generating circuit 6, when it receives the R/W control signal from the CPU 1 through a signal line S15 and a write selecting signal WS from the address decoder 4 through the signal line S4, provides a write signal W on a signal line S11 (FIG. 7(*d*)) and a chip select signal CS on a signal line S12 (FIG. 7(*e*)). When the RAM R/W control signal on the signal line S10, the write signal W on the signal line S11, and the chip select signal CS on the signal line S12 are all at the "L" level, a write operation is carried out from the CPU 1 to the graphic RAM 8.

Figure 8:
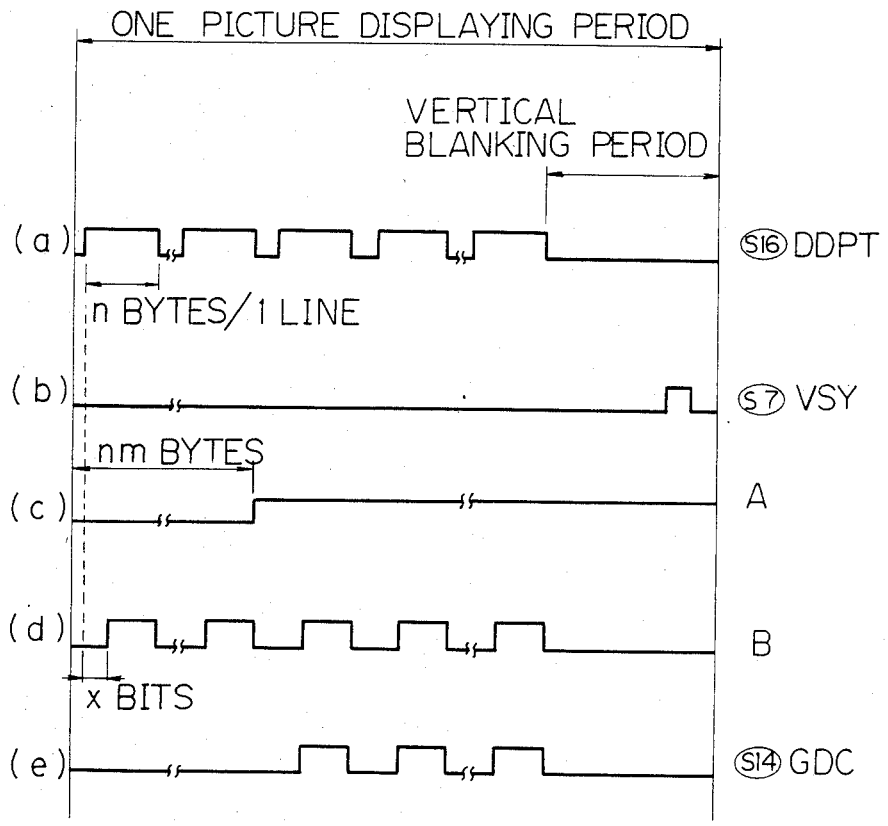

The timing signal generating circuit 6 further provides a graphic dot control signal GDC on a signal line S14. The graphic dot control signal GDC inhibits the output of the graphic RAM from being output from the AND gate 10 so that the data, corresponding to the non-displayed portion on the display panel R after the shift, as is illustrated in FIG. 4C and FIG. 4D by the slanted lines, is not output. The inhibit function provided by the graphic dot control signal GDC is described with reference to FIG. 8. In FIG. 8, (*a*) represents the delayed-display timing signal DDPT on the signal line S16 for a one-picture displaying period. The delayed display timing signal DDPT has n bytes of data for each horizontal line, as is apparent from FIG. 6. At the end of the one-picture displaying period, a vertical blanking period is provided, during which the delayed display timing signal DDPT is at the low level "L". Also in FIG. 8, (*b*) represents the vertical synchronizing signal VSY and (*c*) represents the positive state or the negative state of the counted value in the address generator 5. Assume that the amount of shift is $m \times n$ bytes plus x bits, where m, n, and x are positive integers. Then the value of "$-m \times n$" is preset in the first counter in the address generator 5 as a negative value. The first counter counts up the preset negative value one by one every time it receives a pulse of the bit shift control signal BSC on the signal line S13 shown in FIG. 6(*c*). When the counted value exceeds the absolute value of the preset negative value, i.e., $n \times m$, the counted value of the address generator 5 turns to a positive value.

The duration of the low level state in the signal of FIG. 8(*c*) determines the shift of m horizontal lines. In the following, the shifted part of the m horizontal lines is referred to as an A part of shift.

The lower x bits in the amount of shift, which are smaller than n bytes, are previously supplied to a second counter (not shown) in the timing signal generating circuit 6. In response to a rise of the delayed display timing signal DDPT, the counter in the timing signal generating circuit 6 counts down the x bits one by one every time it receives a pulse of the main clock signal MC. The timing signal generating circuit 6 generates the signal shown in FIG. 8(*d*), which signal rises when the count value of the second counter becomes zero and falls in response to a fall of the delayed display timing signal DDPT. In the signal of FIG. 8(*d*), the duration between the rise of the delayed display timing signal DDPT and the subsequent rise of the signal of FIG. 8(*d*) determines the shift of x bits in one horizontal line. In the following, the shifted part of the x bits in each horizontal line is referred to as a B part of shift. By obtaining a logical product between the signal of FIG. 8(*c*) and the signal of FIG. 8(*d*), the graphic dot control signal GDC can be obtained on the signal line S14, as is illustrated in FIG. 8(*e*).

The multiplexer 7 provides the write address signal WAD from the CPU 1 or the read address signal RAD from the address generator 5 to the graphic RAM 8 in response to the RAM R/W control signal on the signal line S10 shown in FIG. 7(*c*).

The functions of the graphic RAM 8, the parallel-serial converter 9, and the AND gate 10 for controlling graphic dots are well known and therefore are not described here.

The operation of the circuit of FIG. 5 will now be described.

At first, the CPU 1 writes graphic data having an amount of shift being zero into the graphic RAM 8 during the writing period WP in the write signal W shown in FIG. 7(*d*). Then, in accordance with a requirement for shifting the picture to be displayed on the display panel R, the data representing the amount of shift ($m \times n$ bytes plus x bits) is written into the storage unit 3 for latching the data of the amount of shift. Next, the negative number ($-n \times m$) corresponding to the data of $n \times m$ bytes, which represents the A part of shift, is preset in the address generator 5. Also, the number x corresponding to the data of x bits, which represents the B part of shift, is preset in the timing generating circuit 6. Based on the lower bit data of the x bits smaller than n bytes, the lower bit data being smaller than one byte, i.e., 0 through 7 bits, the delayed display timing signal DDPT and the bit shift control signal BSC are output from the timing generating circuit 6 as was described before. The address generator 5 counts the preset number of bytes, i.e., the number ($-n \times m$), and then, after the number $-n \times m$ is counted up, the address generator 5 sequentially accesses the graphic RAM 8 to read data therefrom. The read data for each access is 8-bit parallel data which is input into the parallel-serial converter 9. The output of the parallel-serial converter 9 is gated through the AND gate 10 by the signal on the signal line S14 shown in FIG. 8(*e*). The output of the AND gate 10 is a video signal.

Figure 9:
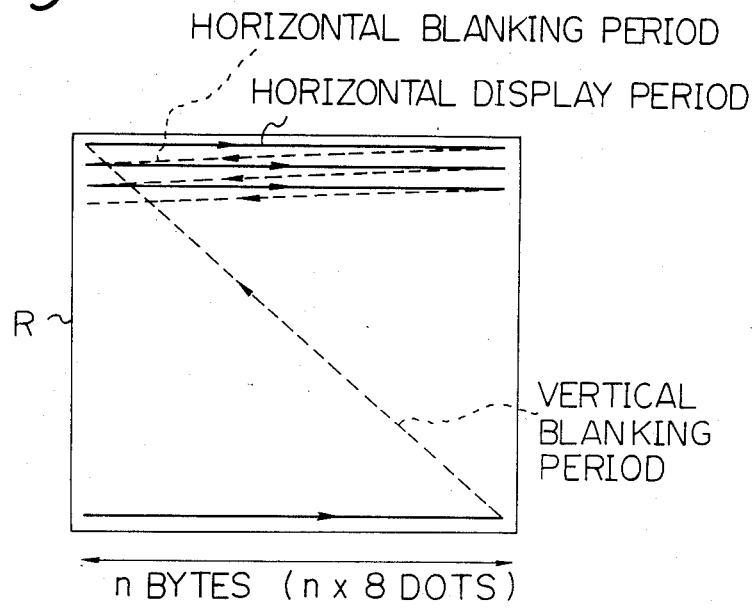
FIG. 9 is a diagram showing the scanning state of the display panel when the amount of shift is zero.

FIG. 9 is a diagram showing the scanning state of the display panel R when the amount of shift is zero. In this case, as is well known, one picture image is displayed by repeating alternately a horizontal display period of n bytes and a horizontal blanking period. After one picture image is displayed, a vertical blanking period is provided and then the horizontal scannings are again repeated.

Figure 10:
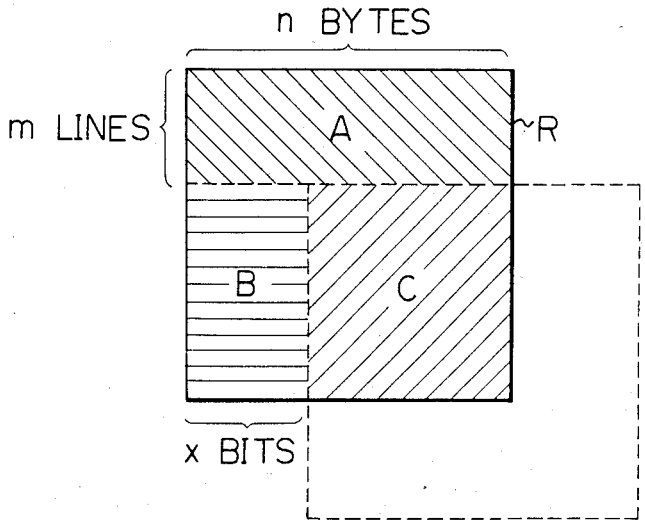
FIG. 10 is a diagram showing the state of the display panel when the amount of shift is $n \times m$ bytes plus x bits.

FIG. 10 is a diagram showing the state of the display panel R when the amount of shift is $n \times m$ bytes plus x bits. As can be seen from the previous description, the A part of shift consists of m horizontal lines, and the B part of shift consists of x bits for each horizontal line. The length of the x bits is smaller than the length of one horizontal line. As a result, the picture image is displayed on the remaining portion C on the display panel R.

In the foregoing description, only one picture image of graphic data is written into the graphic RAM 8 for the sake of simplicity. The present invention, however, is not restricted to the above-described embodiment. Various changes and modifications are possible without departing from the spirit of the invention. For example, graphic data for a plurality of picture images may be provided, and, by synthesizing these picture images, a more complicated shift of the picture images is also possible according to the present invention.

From the foregoing description, it will be apparent that, according to the present invention, in a graphic display unit, by reading and displaying data in a graphic RAM with an appropriate timing in accordance with the amount of shift, the shift on the display panel of the data of the picture image stored in the graphic RAM can be effected very rapidly, for example, within 20 milliseconds.

I claim:

1. A graphic display unit comprising:

a graphic random access memory for storing data of at least one picture image, a clock signal generating means for generating a main clock signal and a divided clock signal obtained by dividing said main clock signal, a control means for generating a display timing signal synchronous with said divided clock signal, and a display panel for displaying said data stored in said graphic random access memory while said display timing signal is on, characterized in that said graphic display unit further comprises a shifting means for shifting said picture image a designated amount to a designated position on or off said display panel, said shifting means comprising:

a signal delaying means for delaying said divided clock signal and said display timing signal in accordance with a designated amount of shift of said picture image, whereby, in response to the delayed divided clock signal and the delayed display timing signal, said data of the picture image is read from said graphic random access memory; and a storage means for latching the designated amount of shift of said picture image, said designated amount of shift having a format consisting of high-order data expressed by $m \times n$ bytes and low-order data expressed by x bits, where m, n and x are zero or positive integers, n bytes are necessary for shifting one horizontal line on said display panel, and x bits are smaller than n bytes;

said signal delaying means having means for delaying said divided clock signal and said display timing signal by the amount of the lower bit data in said x bits, said lower bit data being smaller than one byte.

2. A graphic display unit as set forth in claim 1, wherein said shifting means further comprises:

a first counter means for counting the amount of said high-order data ($m \times n$ bytes) by means of the delayed divided clock signal, a read means for generating a read address to read data stored in said graphic random access memory while the delayed display timing signal is on and after said first counter means counts up the amount of said high-order data, a second counter means for counting the amount of said low-order data (x bits) by means of said main clock signal, said counting being started in response to said delayed display timing signal being turned on, and a gate means for outputting the data read by said read means after said second counter means counts up the amount of said low-order data.

3. A graphic display unit as set forth in claim 2, further comprising:

a central processing unit for providing write data, the data of said designated amount of shift, a write address signal, and a read/write control signal;

an address decoder for decoding said write address signal so as to select a read/write operation of said designated amount of shift from or into said storage means, a write operation into said graphic random access memory, or a display operation by triggering said control means, in accordance with respective decoded write addresses;

a timing signal generating circuit including means for generating a RAM read/write control signal formed within the duration of said delayed display timing signal;

an address generator including said first counter means and said read means; and a multiplexer for providing either said read address from said read means or said write address from said central processing unit to said graphic random access memory in response to said RAM read/-write control signal from said timing signal generating circuit.

* * * * *